US005095649A

United States Patent [19]

Brownlee

[11] Patent Number: 5,095,649

[45] **Date of Patent: * Mar. 17, 1992**

[54] STORAGE RECEPTACLE ASSEMBLY

[75] Inventor: Richard W. Brownlee, Spartanburg, S.C.

[73] Assignee: Flo-Step, Inc., Spartanburg, S.C.

[ * ] Notice: The portion of the term of this patent subsequent to Feb. 13, 2007 has been disclaimed.

[21] Appl. No.: 598,228

[22] Filed: Oct. 16, 1990

[51] Int. Cl.[5] ..... A47F 3/04

[52] U.S. Cl. ..... 47/41.01; 47/41.11; 47/79; 47/82

[58] Field of Search ..... 47/41.01, 41.11, 41.12, 47/82, 83

[56] References Cited

U.S. PATENT DOCUMENTS

| | | |
|---|---|---|
| 147,849 | 2/1974 | Leslie . |
| D. 188,990 | 10/1960 | Lowe . |
| 780,627 | 1/1905 | Umbehend . |
| 1,153,028 | 9/1915 | Chalk . |
| 1,558,357 | 10/1925 | Henley . |
| 1,764,543 | 8/1928 | Barton . |
| 2,261,326 | 11/1941 | Atkisson et al. . |
| 2,463,719 | 3/1949 | Schackett et al. . |
| 2,940,218 | 6/1960 | Carter . |
| 3,365,840 | 1/1968 | Cooper . |
| 3,686,792 | 8/1972 | Barfield . |
| 4,006,559 | 2/1977 | Carlyon, Jr. . |
| 4,334,386 | 6/1982 | Burcombe et al. . |
| 4,546,571 | 10/1985 | Scrivens . |
| 4,608,776 | 9/1986 | Kooy . |
| 4,899,487 | 2/1990 | Brownlee ..... 47/41.01 |

FOREIGN PATENT DOCUMENTS

| | | |
|---|---|---|
| 3149102 | 6/1983 | Fed. Rep. of Germany . |
| 415179 | 9/1910 | France . |

*Primary Examiner*—Richard E. Chilcot, Jr.
*Assistant Examiner*—Joanne C. Downs
*Attorney, Agent, or Firm*—Cort Flint

[57] ABSTRACT

An assembly for storage of floral items or the like which includes a housing made up of stepped side walls, a rear wall, a front wall section at each step and top wall sections at each step. At least one container is located at each step, preferably received in an opening defined by the top wall section thereat. The containers define at least one water drain opening therein which is associated with a water drain system and with appropriate controls for maintaining water within the container or draining same therefrom. A cut item separator support may be provided within the containers for dividing the inside of the containers into a plurality of compartments for the receipt of floral items therein and for water-free transfer of foliage from one container to another.

14 Claims, 3 Drawing Sheets

STORAGE RECEPTACLE ASSEMBLY

BACKGROUND OF THE INVENTION

The present invention relates to an assembly for the receipt of cut flowers, fern, greenery or the like where the items received in the assembly are maintained in a proper environment for sustained display and/or storage. This application relates to my previously filed application, now U.S. Pat. No. 4,899,487.

At all levels of the floral business, whether grower, wholesale, retail or the like, quantities of cut flowers and other greenery are routinely maintained in-house for various and sundry purposes. Notably, at each level in the floral industry, it is necessary for the business to maintain significant quantities of cut flowers and greenery in inventory for either routine work in the preparation of floral arrangements or as inventory for resale to others. As is obvious, such floral items once cut from its living plant, thereafter will enjoy a limited useful life before wilting, or other deterioration to a point where the cut items cease to retain their freshness and beauty adequate for their intended purpose. In order to prolong the lifespan and preserve the beauty of these cut floral items, the industry has, in general, maintained the items in a body of water and further, when possible, maintained the items in a refrigerated environment.

Further, at the grower level, the wholesale level, or the retail level, the maintenance of cut floral items in water and in a refrigerated environment coupled with transport of the items, replenishment of the water, and the like has been fraught with problems. Particularly, current handling techniques have historically involved the placement of a quantity of the cut floral materials into a bucket or other like container coupled with the manual removal of the items from the container when desired to pour out the water at periodic intervals and thereafter replenish the supply of water and replace the items into the container. Furthermore, such handling has also involved the manual transport of the containers into and out of a refrigerated environment. Not only do the above exercises involve excessive labor due to the handling of multiple containers, but also repeated handling of the fragile cut floral items often leads to inadvertent damage to the product. Moreover, such handling techniques and placement of the cut floral items into a container with water are especially critical with certain floral items where a long stem is involved, and where the item is subject to bend or droop about the stem when not properly supported.

Since floral items are generally fairly expensive and are very fragile and subject to bruising, breakage of leaves or petals or the like, it is highly important that a system be available for use which will minimize the handling of the individual cut items as well as minimize the time involved in replacement of water, transport of the items into and out of the refrigerated environment and the like. Such improvements in the industry will not only lead to improved economy at the growing, wholesale and retail levels, but also will enhance the sustained beauty of the floral items and prolong the expected useful life of same. The present invention affords such a system, in that, there is provided for the use in a single assembly, or assembly module, a significantly increased capacity for receipt of cut floral items, an ability to maintain the items in the container at a desired or necessary disposition or attitude, an ability to replenish water in the container in a rapid and efficient manner, and an ability to move the cut items into and out of a refrigerated environment with little effort. Moreover, not only does the assembly of the present invention preclude the necessity of repeated handling of the cut floral items until they are intended to be sold or used in preparation of a floral arrangement, the assembly of the present invention likewise affords in addition to the above, an improved and effective display for floral items at a retail level.

Historically, as noted above, containers for storage and display of cut flowers and other greenery have taken the form of buckets or like containers. Additionally, U.S. Pat. No. 1,764,543 to Barton discloses a flower table in which a plurality of stepped or terraced sections are provided having a series of circular openings along each shaft for receipt of potted plants, and with the steps being adjustable as to height to properly position the potted plants at a window for appropriate sunlight. Each of the stepped sections having the series of circular openings therein, has a trough located therebeneath to receive excess water as it drips from the pots with the troughs being elevationally adjustable at one end to permit drainage of water therefrom into an appropriate waste water receptacle. Additionally, U.S. Pat. No. 147,849 to Leslie shows a circular stand having stepped individual pot receiving elements therearound with appropriate drain connections between the pot receiving sections and a central column for discharge of the water. Likewise, a fountain is located at the top of the central column for water spray onto the potted plants. U.S. Pat. No. 4,006,559 to Carlyon, Jr. discloses a self-irrigating display rack for potted plants in which a series of circular shelves are located along a central column.

Further examples of relevant prior art include U.S. Pat. No. 780,627 to Umbehend which discloses a cylindrical container having a plurality of tubular members for holding individual flowers in an upright position for viewing and U.S. Pat. No. 2,463,719 to Schackett et al. which discloses a large container on which individual frames having apertures defined therethrough for the receipt of flower pots are positioned. U.S. Pat. No. 4,608,776 to Kooy is directed to a cooler for cut flowers where the flowers can be displayed while being cooled. By such invention cooling air is continually passed about an underside of individual flower boxes located in the display case while avoiding excessive cool air contact with the cut flowers themselves. French patent 62,922 discloses a hand pumping arrangement for providing water to flower pots as well as a tiered drainage system for receiving the drainage from the plants.

Also of general interest are U.S. Design Pat. No. 188,990 to Lowe which disloses a flower pot shelf unit, U.S. Pat. No. 2,261,326 to Atkisson et al. which discloses a mesh support for holding individual cut flowers in an upright position, U.S. Pat. No. 4,546,571 to Scrivens which discloses a watering system for growing plants, U.S. Pat. No. 1,558,357 to Henley which discloses a flower box for planted flowers, U.S. Pat. No. 1,153,028 to Chalk which discloses a tiered stand for the display of potted plants or individual cut flowers. German DE 31 49 102 to Grunicke is similarly directed to a tiered display support frame.

Still further, U.S. Pat. Nos. 3,365,840 to Cooper, 2,940,218 to Carter; 3,686,792 to Barfield; and 4,334,386 to Burcombe et al. each disclose arrangements, some of which are tiered, for hydroponic type growing systems or systems for supplying liquids to potted plants. It is submitted that the present invention is patentably distinct over the above-noted known prior art, and that the above patents neither individually nor collectively teach nor suggest same.

SUMMARY OF THE INVENTION

It is an object of the present invention to provide an improved assembly for storage and/or display of cut flowers, greenery and the like.

Another object of the present invention is to provide an improved assembly in which cut flowers, greenery and the like may be received in a tiered arrangement and maintained to decrease the likelihood of damage to the items while in the assembly.

Still further, another object of the present invention is to provide a stationary assembly which may serve as a master container unit for use with other portable units.

Yet another object of the present invention is to provide such a stationary unit which may be installed within a cooler or the like to serve as a master storage unit for flowers and greenery in a florist's shop or the like.

It is a still further object of the present invention to provide a floral container assembly which is easily and economically produced having a limited surface area and no drain lines.

It is yet another object of the present invention to provide a tiered floral container assembly which allows the user easy access to flowers and greenery contained in the top-most tier.

Generally speaking, the assembly according to the present invention for storage of cut flowers, greenery or the like comprises a housing, said housing including opposite stepped side walls, a rear wall, a plurality of front wall sections, one of said front wall sections being provided for each step of said side walls, and upper wall sections provided at each step of said side walls, said upper wall sections being generally planar and defining at least one opening therein, a container receivable in each of said upper wall openings and extending down into said housing, said containers including a bottom wall and four side walls secured thereto and extending upwardly therefrom and cooperating therewith to define an open compartment for receipt of said items, at least certain of said container side walls having a flange secured thereto and extending outwardly therefrom for contact with portions of said housing upper wall about said opening, one wall of said containers defining a drain opening therein, means associable with said drain openings of said containers for drainage of water from said containers, and separator means located in said containers for separating said container compartment into sections of predetermined size. The assembly preferably includes a means for installation in a cooler or the like.

More specifically, the storage assembly according to the present invention preferably includes a housing that is of unitary construction, preferably having been molded from fiberglass or some other reinforced polymeric material where the housing has a tiered construction on one side thereof and with the upper wall section of each step or tier defining openings that cover a substantial portion of the area of the step or tier for receipt of mating containers therein. Each container serves as a receptacle for the cut flowers or the like and is adapted for drainage of water therefrom as desired.

In a most preferred embodiment, an angled wall extends from the bottom portion of the rear wall to the rear portion of the bottom wall limiting the internal volume and the overall surface area of the housing. Most preferably, the bottom wall of the housing extends beneath the first step only.

Openings defined in the lower portions of the containers have closure means such as stoppers which may be removed, allowing water to drain from the containers into the housing. The angled wall allows for collection of the drainage in the bottom-most portion of the housing beneath the first step. Water drain means associated with the lower portion of the housing provide for drainage of the collected water therefrom.

The housing for the present assembly is preferably solid along front and side walls with the top walls having the appropriate container receiver openings. Most preferably, a recessed portion is defined along the lower portion of the bottom-most front wall. Thus, a user reaching for the upper-most tier can get closer to the unit by standing with his feet under the front wall in such recess.

Different cut flowers and greenery are preferentially provided at predetermined heights or stem length such that certain of the items will be quite short while others are quite lengthy. Further, many of the items to be received in the assembly of the present invention are somewhat more fragile and subject to bruising than other and require more delicate care. Of course, the taller the cut item, generally speaking, the more likely the item will bend along its length which also could detrimentally affect the product. Consequently, while containers of varying depths may be provided, one feature of the present invention is to provide a separator structure in the container which is adapted to appropriately maintain the particular cut items received therein. In one embodiment, the support structure assumes a general shape of the inside of the container with one or more elements extending across or along the length of the container which are movable along the support structure to provide a predetermined compartment size into which the particular cut items may be received. In a most preferred embodiment, the supporting structure defines a wire transfer basket which allows for the transfer of cut flowers from one container to another without the excess weight of water.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 4 is a cross-sectional view of a further embodiment of an assembly according to the present invention for storage of cut flowers, greenery or the like.

DESCRIPTION OF THE PREFERRED EMBODIMENTS

Figure 1:
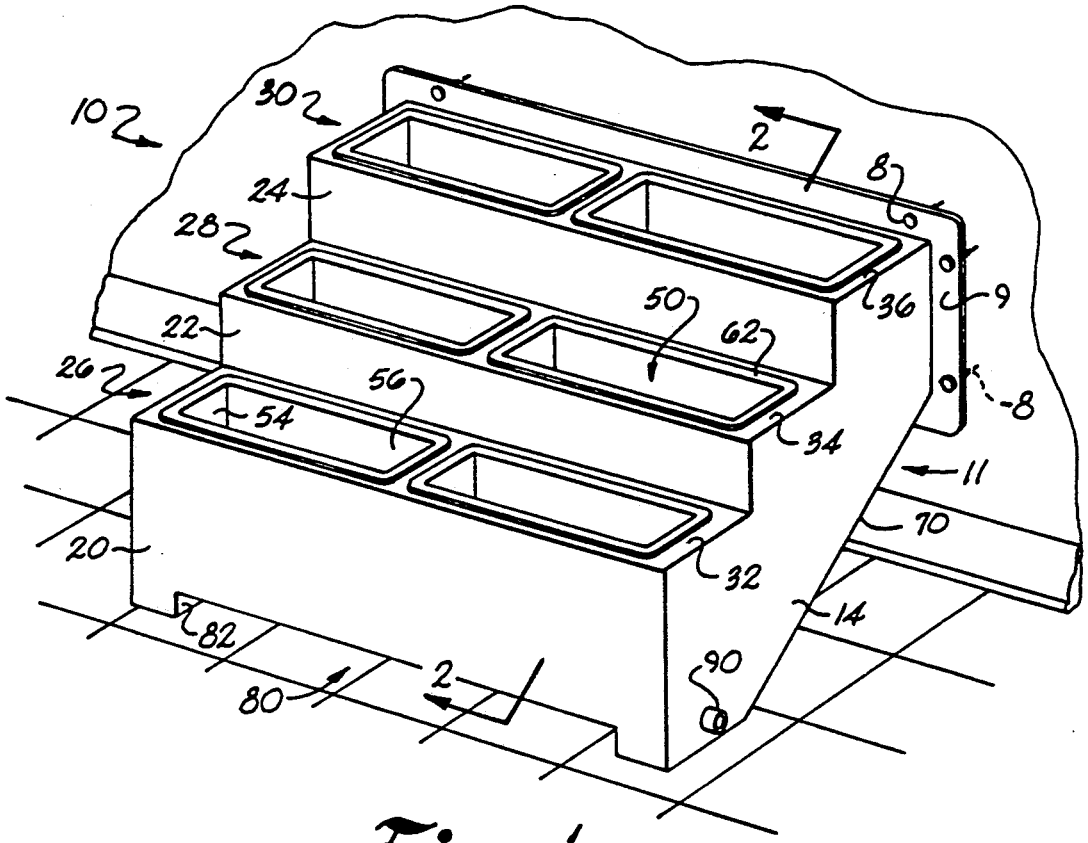
FIG. 1 is a perspective view of a preferred embodiment of an assembly for receiving cut flowers, greenery or the like according to the present invention.
Figure 2:
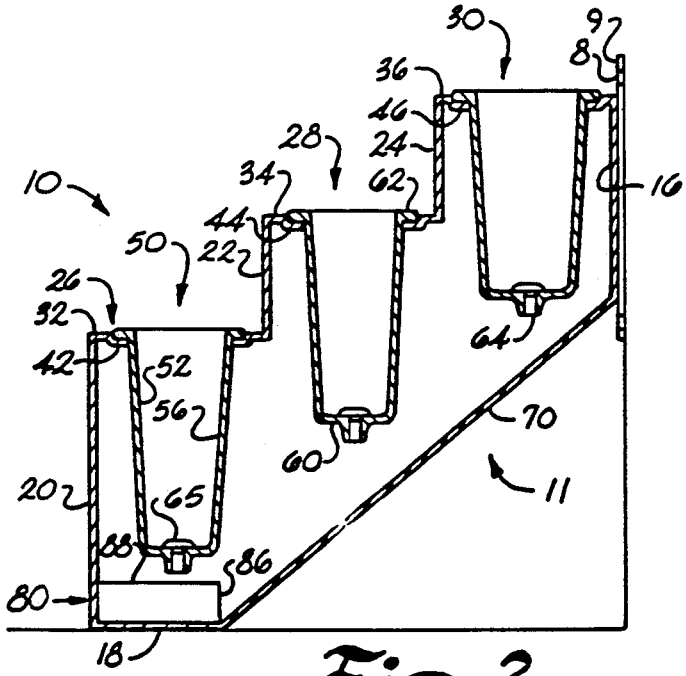
FIG. 2 is a cross-sectional view of the assembly as illustrated in FIG. 1.

Referring to the figures, preferred embodiments of the present invention will now be described in detail. In FIGS. 1 and 2, an assembly generally indicated as 10 is illustrated. Assembly 10 includes a housing 11 which is made up of opposite side walls 12 and 14, a rear wall 16, a bottom wall 18 and a base front wall 20. Preferably, means for permanently installing the assembly in a cooler or the like, such as bolts 8 extending through rear flange 9, are provided at rear wall 16. Side walls 12 and 14 are tiered or stepped in shape to define, in part, steps or tiers generally indicated as 26, 28 and 30 atop assembly 10. Further front wall sections 22 and 24 are located between step sections 26 and 28 and 28 and 30, respectively.

Furthermore, step sections 26, 28 and 30 include top wall sections 32, 34 and 36, respectively, each of which preferably defines at least one opening 40 therein with the openings covering a major portion of the area of the individual top wall sections. For example, in the embodiment of FIG. 1, each top wall section defines two openings which together cover a major portion of the area of such section. Each of the openings is intended to receive a container 50 therewithin. Top wall sections 32, 34, and 36 of steps 26, 28 and 30 include a recessed ledge 42, 44 and 46, respectively, that borders the container receiving opening defined therein.

Container 50, in turn, includes upstanding walls 52, 54, 56 and 58, all secured to a bottom wall 60, all of which cooperate to define an open receptacle within which cut flowers and the like may be received. An outwardly projecting lip or flange 62 is provided around the perimeter of the upstanding walls 52, 54, 56 and 58 such that when a container 50 is received within an opening of the top wall of one of the steps, flange 62 extends down within the top wall 32, 34 or 36 and is received atop the ledge 42, 44 or 46 that surrounds the container receiving opening defined therein.

Figure 2A:
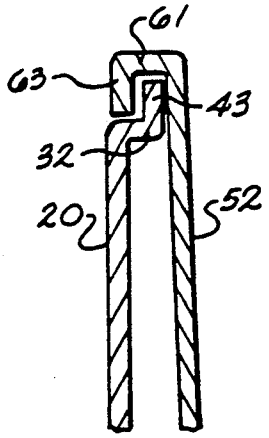
FIG. 2*a* is a close-up view of an alternative container receiving means in accordance with the present invention.

An alternative container receiving means is illustrated in FIG. 2*a*. Exemplary top wall 32 defines an upwardly projecting lip 43 about opening 40. Exemplary side wall 52 of a container 50 defines upper lip 61 with downwardly projecting ridge 63 for hanging on lip 43.

Figure 3:
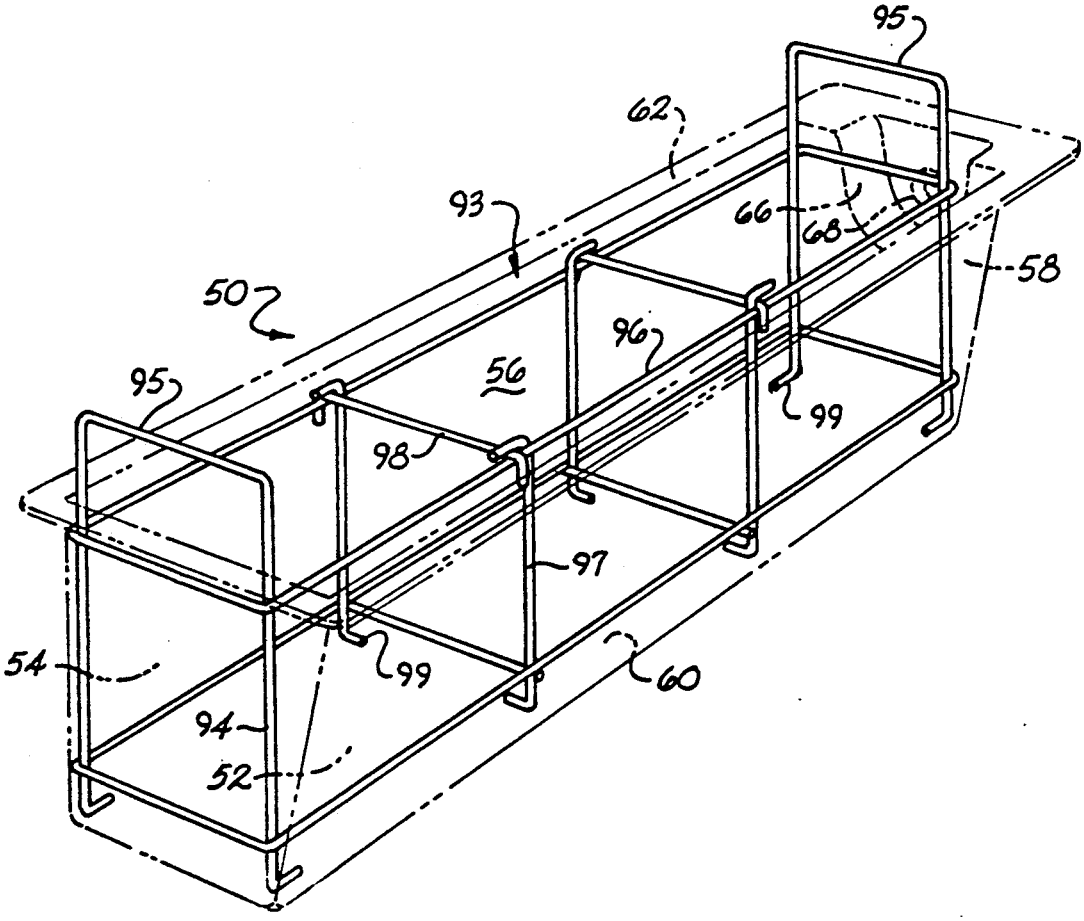
FIG. 3 is an isometric view of a container for receipt in an assembly according to the teachings of the present invention and having a cut item support structure received therein.

Bottom wall 60 of container 50 preferably defines a drain opening 64 shown in FIG. 2. Optionally, the container further may include a detent section 66 in end wall 58 as is shown in FIG. 3. Such detent section preferably defines overflow drain opening 68.

In the present embodiment, drain openings 64 include drainage control means, such as stoppers 65. Although drainage pipes are within the scope of the present invention (see FIG. 4 and the discussion relating thereto below) the embodiment of FIGS. 1 and 2 is particularly suited for a drainage system which does not employ drainage pipes but by which water drained from the individual containers is received in a bottom portion of the housing and may be periodically drained therefrom.

Preferably, housing 11 further includes angled wall 70 connecting rear surfaces of the side walls 12 and 14, the lower surface of the rear wall 16 and the rear surface of the bottom wall 18. Most preferably, bottom wall 18 is of a depth slightly less than that of first step 26. Thus, angled wall 70 extends upwardly to rear wall 16 at an angle that is generally parallel to the grade of the steps. Such angled wall not only decreases the material required for manufacture of the housing but also provides for a reduced bottom portion at which water drained from the individual containers may be collected.

Also defined in the housing is a recessed portion 80 such as is shown in FIGS. 1 and 2 which preferably includes side walls 82 and 84, rear wall 86 and top wall 88. Such recessed portion provides foot room for a user especially when working with flowers in containers in the top step 30. Although shown as having side walls, a rear wall and a top wall, recessed portion 80 may also be defined by side walls and an angled wall extending downwardly to bottom wall 18 of the housing. It should be noted that recessed portion 80, while providing foot room to a user, also serves to reduce the inner volume of the lower portion of the housing at which drainage is collected.

Housing 11 further defines drain means 90 which includes a drainage control means such as a valve. Water drained from the individual containers flows along the inner surface of angled wall 70 and is collected in the bottom portion of the housing. The reduced volume in the bottom portion allows for maximum drainage through drain means 90 upon opening of a control valve. Thus, individual containers may be drained when necessary and the housing may be drained periodically. Drain means 90 further includes connection means such that a hose or the like may be connected thereto to aid in draining of the housing.

Making reference to FIG. 3, a cut item support structure generally indicated as 93 is shown received within a container 50 and includes handle means such as defined by cross members 95 connecting terminal vertical legs 94. Horizontal struts 96 form a generally rectangular skeletal support structure to which are connected intermediate vertical legs 97 and crossing members such as transverse crossing members 98. Preferably, each of the intermediate vertical legs and crossing members are slidably positionable along the length of horizontal struts 96. Longitudinal crossing members are also within the scope of the present invention and may be slidably positionable in the transverse direction. Each of the intermediate and terminal vertical legs further define inwardly extending projections 99.

Thus, the present support structure serves not only to support cut flowers and greenery but also to separate various species of flowers into compartments, the size of such compartments being adjustable depending on the quantity of each species. Further, the present support structure serves as a transfer basket which may be employed to move flowers from one container to another without the excess weight of water. Such feature is especially useful when the assembly of the present invention is permanently installed, such as in the cooler of a florist shop, and is used in conjunction with a portable unit such as is disclosed in U.S. Pat. No. 4,899,487.

Thus, flowers and greenery stored in the cooler in the permanent unit of the present invention may be easily transferred to a portable unit without lifting and transferring full individual containers. It should be noted that for a large bulk of flowers and greenery, only a few crossing members are required, while a greater number of crossing members may be required for a less dense mass of foliage. The crossing members, as well as the horizontal struts, vertical legs and inwardly extending projections 99, serve to catch and support the cut flowers by the stems, leaves and the like.

Figure 4:
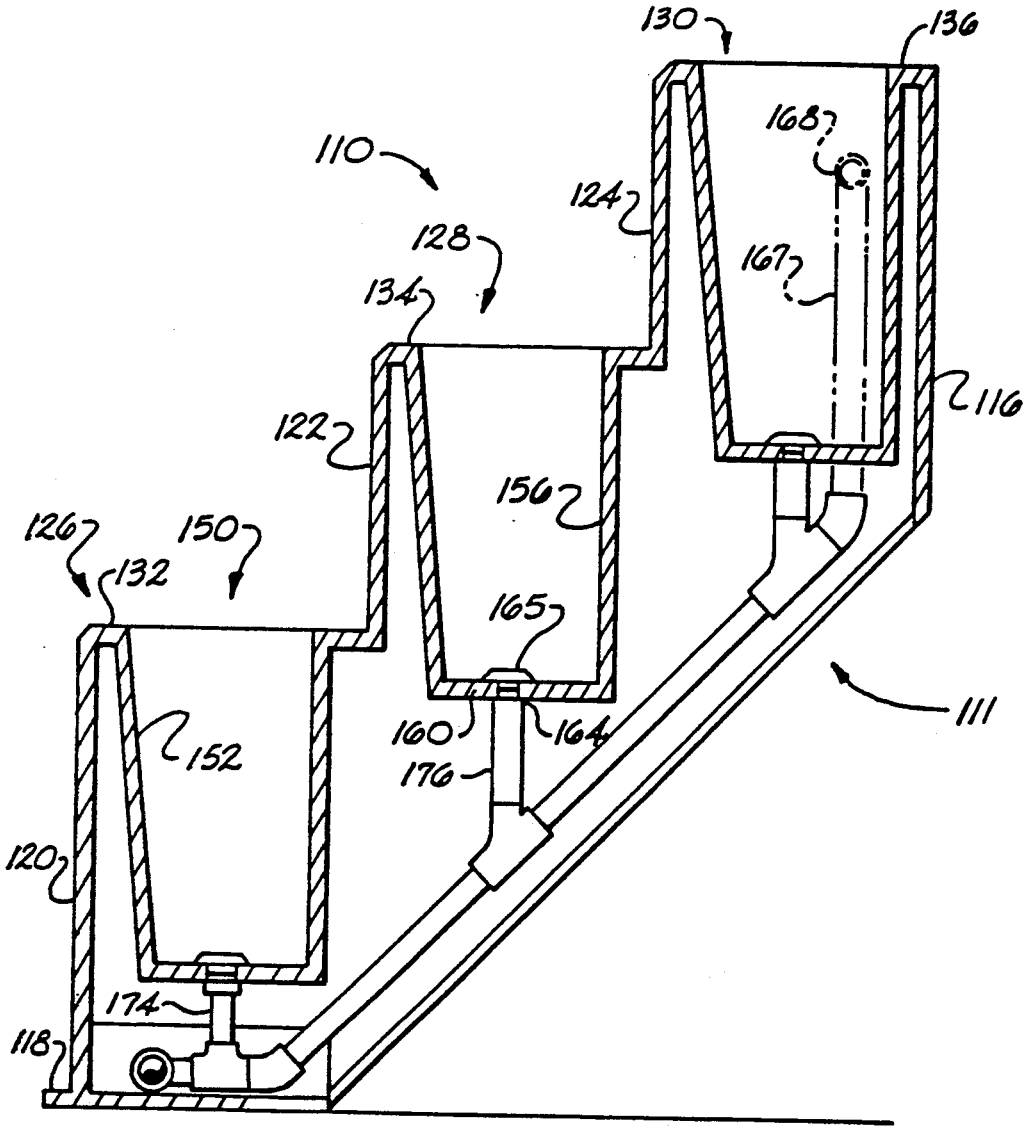

FIG. 4 shows yet a further embodiment of the present invention in which an assembly generally indicated as 110 is totally unitary in construction, including the various walls of the housing and the containers.

Generally housing 111 is made up of opposite side walls 112 and 114, a rear wall 116, a bottom wall 118, and a base front wall 120. Side walls 112 and 114 are stepped to define tiers 126, 128 and 130. Front wall sections 122 and 124 are located between tiers 126 and 128, and 128 and 130, respectively.

Tiers 126 128 and 130 include top wall sections 132, 134 and 136, respectively, each of which defines at least one opening which, because of the integral nature of the present embodiment, defines a container 150.

As with the above discussed embodiment, container 150 further defines side walls 152 and 156 which are shown for each container, and 154 and 158 not shown by the present cross-sectional view.

Additionally, as can be seen, a water drain means generally 164 is provided in bottom wall 160. Generally, the drainage system of the present embodiment includes a common drain conduit 172 with vertical legs 174, 176 and 178 being connected thereto with an upper end of same extending into containers 150 at each of the drain openings generally 164 having drain closing means such as stoppers 165.

Optionally, overflow drainage outlets, such as shown in phantoms at 168 on the container of top tier 130, having connecting conduit 167 extending downwardly therefrom and connected to conduit 178, may be provided to prevent overflow of the containers and to permit water to be continually added. It is also within the scope of the present invention to provide overflow drainage outlets only. However, bottom drains provided in either the bottom wall as illustrated or the lower portion of a side wall are preferred.

Thus, the drainage system of the present embodiment may be opened by a control valve associated with main conduit 172. Individual containers may be drained by release of the various stopper means 165. Conduit 172 preferably further includes connection means such that a hose or the like may be connected thereto to aid in draining of the drainage system.

Assemblies according to the present invention can be provided in any desired length. A five foot long unit having two approximately 28 inch long containers per tier and three tiers is, however, preferred.

While a number of different embodiments of different aspects of the present invention have been described hereinabove, it should be pointed out that any of the various embodiments may be interchanged with other of the various embodiments as desired to provide a particular unit structure. It is understood that while the present invention has been described as being stationarily located, it is well within the scope of this invention to mount the assembly on casters as disclosed in U.S. Pat. No. 4,899,487 so as to be portable.

It will be understood, of course, that while the form of the invention herein shown and described constitutes preferred embodiments of the invention, it is not intended to illustrate all possible form of the invention. It will also be understood that the words used are words of description rather than of limitation and that various changes may be made without departing from the spirit and scope of the invention herein disclosed.

What is claimed is:

1. An assembly for display and storage of cut flowers, greenery and the like comprising:

a) a housing, said housing including opposite side walls, said side walls being stepped, a back wall, a plurality of front wall sections, one of said front wall sections being provided for each step of said side walls, and upper wall sections provided at each step of said side walls, said upper wall sections being generally planar and defining at least one opening therein;

b) a container receivable in each of said upper wall openings and extending down into said housing, said containers including a bottom wall and four side walls secured thereto and extending upwardly therefrom and cooperating therewith to define an open compartment for receipt of said items, at least certain of said container side walls having a flange secured thereto and extending outwardly therefrom for contact with portions of said housing upper wall about said opening, one wall of each of said containers defining a drain opening therein;

c) means associable with said drain openings of said containers for drainage of water from said containers; and d) separator means receivable in said containers for separating said container compartments into sections.

2. An assembly as defined in claim 1 further including installation means for securing said housing to a supporting structure.

3. An assembly as defined in claim 1 wherein said housing and said containers are constructed of polymeric material.

4. An assembly as defined in claim 1 wherein said separator means are transfer baskets providing for water-free transfer of cut flowers from one container to another container.

5. An assembly as defined in claim 1 further including means for collecting water drained from said containers in a lower portion of said housing.

6. An assembly as defined in claim 5 further including a drain opening defined in the lower portion of said housing and means associable with said drain opening in said housing for drainage of water from said housing.

7. An assembly as defined in claim 1 further including a small bottom wall and an angled wall extending from said bottom wall to said back wall.

8. An assembly as defined in claim 7 further including a second angled wall extending from said bottom wall to the lowermost front wall section defining a rebated portion in said lowermost front wall section.

9. An assembly for receipt of floral items and the like comprising:

a) a housing, said housing including opposite side walls having stepped upper surfaces, a back wall extending between said side walls, a front wall section extending between said side walls at each step and upper wall sections extending between said side walls at each step;

b) at least one container located at each step and extending down into said housing, said containers defining drain openings therein; and c) water drain means associated with said container drain openings for removal of water therefrom, said drain means including control means.

10. An assembly as defined in claim 9 wherein each of said upper wall sections defines openings therein and said containers are received in said openings.

11. An assembly as defined in claim 9 wherein said housing is of unitary construction.

12. An assembly as defined in claim 9 wherein said drain means is located within said housing and comprises a common conduit with legs secured between said drain openings in said containers and said common conduit and wherein stoppers are provided to seal said drain openings when desired.

13. An assembly for receipt of floral items and the like, comprising:

a) a unitary housing, said housing including opposite side walls having a rear surface and an upper surface, a rear wall connecting said side walls along said rear surfaces, a front wall section connecting said side walls, top wall sections connecting said side walls and defining at least one opening therein, and a bottom wall connected to said side walls, rear wall and front wall section defining a bottom portion beneath said opening;

b) a container removably receivable in each opening in said top wall sections, said containers defining a drain opening in a lower portion of same;

c) closure means associable with said drain openings in said containers for control of containment of water in said containers; and d) water drain means associated with said housing in a lower portion of one of said walls thereof whereby water may be drained from said containers into said bottom portion of said housing for subsequent drainage therefrom.

14. An assembly as defined in claim 13 wherein said housing is mounted on casters for mobility.

* * * * *